United States Patent [19]

Sheth

[11] 4,143,238

[45] Mar. 6, 1979

[54] SHIELDED ULTRA-MINIATURE CABLE

[75] Inventor: Ramesh D. Sheth, Richmond, Ind.

[73] Assignee: Belden Corporation, Geneva, Ill.

[21] Appl. No.: 772,633

[22] Filed: Feb. 28, 1977

[51] Int. Cl.[2] ..... H01B 7/18

[52] U.S. Cl. ..... 174/107; 174/102 SC

[58] Field of Search ..... 174/105 SC, 102 SC, 174/106 SC, 120 SC, 107, 119 C, 120 SR; 428/380, 383

[56] References Cited

U.S. PATENT DOCUMENTS

| | | | |
|---|---|---|---|
| 2,518,789 | 8/1950 | Jackson | 174/115 |
| 2,694,650 | 11/1954 | Herman et al. | 174/120 SR X |
| 3,096,210 | 7/1963 | Boonstra | 174/102 SC |
| 3,098,893 | 7/1963 | Pringle et al. | 174/102 SC |
| 3,384,958 | 5/1968 | Christian et al. | 219/58 |
| 3,418,444 | 12/1968 | Ruehlmann | 174/94 R |
| 3,433,687 | 3/1969 | Price | 174/102 SC |
| 3,474,189 | 10/1969 | Plate et al. | 174/102 R |
| 3,569,611 | 12/1969 | Berends | 174/120 SC |
| 3,660,592 | 5/1972 | Anderson | 174/114 R |
| 3,775,548 | 11/1973 | Zinser, Jr. et al. | 174/107 |
| 3,842,192 | 10/1974 | Hilker et al. | 174/120 SR |
| 3,906,139 | 9/1975 | Hiraoka et al. | 428/383 |

*Primary Examiner*—Laramie E. Askin
*Assistant Examiner*—Earl F. Borchelt
*Attorney, Agent, or Firm*—Fitch, Even, Tabin & Luedeka

[57] ABSTRACT

A shielded ultra-miniature cable suitable for example to provide low voltage connections, the cable including one or more low voltage conductors surrounded by an insulation coating, the insulation coated conductors being surrounded by a semiconductive coating providing a ground shield. The insulation and semiconductive coating are formed from thermoplastic materials of limited thickness to permit soldering of said shielded cable without requiring prior removal of said semiconductive and insulation coatings and to maintain minimum dimensions for the cable.

13 Claims, 6 Drawing Figures

SHIELDED ULTRA-MINIATURE CABLE

BACKGROUND OF THE INVENTION

The present invention relates to an ultra-miniature shielded cable and more particularly to such a cable employed to provide low voltage connections as well as a method of forming a solder connection for the cable.

Low voltage cable connectors are commonly used in various types of instrumentation to transmit low voltage signals or to detect low level electrostatic charges. A typical application may include a conductor for connecting a suitable probe with an electrostatic voltmeter. Such an ultra-miniature cable may also be employed in numerous other types of instrumentation to serve a similar purpose.

Many variations of shielded or coaxial cables are available in the prior art. However, these conventional cables are in general excessively large for applications of the type contemplated by the present invention.

In addition, such ultra-miniature cables may commonly be employed in short lengths of two inches (five centimeters), for example, as low voltage connections. Accordingly, it is also a problem to strip the coating material from the conductors in order to permit a positive connection with the low voltage conductor itself.

Yet another problem encountered in such applications is the need to prevent or substantially eliminate pickup of spurious noise or the imposition of external voltages upon the low voltage conductor. In applications where the ultra-miniature cable is being employed as a connection for an electrostatic voltmeter probe, for example, the development of such signals upon the low voltage conductor itself tends to excessively interfere with accurate detection or transmission of a low voltage signal by the conductor.

Accordingly, there has been found to remain a need for a shielded ultra-miniature cable for use in low voltage applications.

SUMMARY OF THE INVENTION

It is therefore an object of the present invention to provide a shielded ultra-miniature cable suitable for use as a low voltage connection while overcoming one or more problems of the type discussed above.

It is a further object of the invention to provide a shielded ultra-miniature cable including an insulation coating for one or more conductors in the cable and a semiconductive coating providing a ground shield for the insulation coated conductors, the insulation and semiconductive coatings being selected to permit soldering of the cable without requiring prior removal of the semiconductive and insulation coatings.

It is an even further object of the invention to provide a shielded ultra-miniature cable wherein the thicknesses of the insulation and semiconductive coatings are limited in order to maintain minimum dimensions for the cable while also allowing the semiconductive coating to serve as an effective ground shield for preventing spurious noise pickup or voltage imposition on the low voltage conductor.

It is also an object of the present invention to provide a method of forming an electrical connection for a shielded ultra-miniature low voltage cable wherein a cable of the type referred to above is employed with the insulation and semiconductive coatings being melted to expose the low voltage conductor during the soldering operation.

Additional objects and advantages of the invention are made apparent in the following description having reference to the accompanying drawings.

DESCRIPTION OF THE PREFERRED EMBODIMENTS

FIGS. 1–3A disclose various embodiments of a shielded ultra-miniature low voltage cable according to the present invention. The embodiments of FIGS. 1–3A are similar in that the cables have external dimensions or diameters on the order of approximately 0.015 to 0.025 inches (0.0375 to 0.0625 centimeters), for example.

Each of the cables includes one or more low voltage conductors continuously surrounded by a thin insulation coating to maintain electrical integrity of the conductors. The insulation coated conductors are in turn surrounded by a semiconductive coating which serves as a ground shield for the low voltage cable and accomplishes a primary function of preventing spurious noise pickup or voltage imposition on the low voltage conductors.

The internal insulation coating and the semiconductive coatings are of materials and thicknesses selected to permit soldering of the shielded cable or low voltage conductors without requiring prior removal of either the insulation coating or the semiconductive coating. Preferably, both the insulation coating and the semiconductive coating are formed from thermoplastic materials which melt during soldering of the cable so that a solder connection is formed directly with the low voltage conductor. In addition, the thicknesses of the internal insulation coating and the semiconductive coating are maintained at a minimum to permit miniaturization of the entire cable while further assuring that extraneous signals are not applied to the low voltage conductors.

The semiconductive coating for each embodiment of the cable may in turn be surrounded by an external insulation coating in order to provide electrical insulation for selected applications. Preferably, the external insulation coating is also maintained at a minimum thickness and is formed from a suitable material such as a thermoplastic composition to permit solder connections to be formed with the low voltage conductors without the need for prior removal of the internal insulation coating, the semiconductive coating or the external insulation coating.

Figure 1:
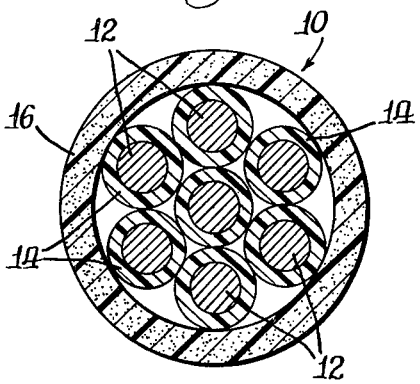
FIG. 1 is a sectioned view of a shielded ultra-miniature cable according to the present invention and including a plurality of stranded conductors.

Referring now to FIG. 1, a shielded ultra-miniature cable according to the present invention is indicated at 10 and includes a plurality of seven low voltage conductors 12 which may be formed from copper, silver, steel, aluminum, alloys of such conductive materials or the like. In general, any conductive metal or material may be employed for the low voltage conductors of the present invention. Each of the conductors 12 has an electrically continuous thin insulation coating 14. The insulation coated conductors 12 are in turn surrounded by a semi-conductive coating 16 which thus serves as a ground shield for the entire cable 10.

The materials and thicknesses of the insulation coatings 14 and the semiconductive coating 16 are carefully selected to accomplish a number of essential functions within the present invention. Initially, the ultra-miniature cable 10 permits the formation of soldered connections without the need to first remove the insulation coatings 14 or the semiconductive coating 16. Accordingly, the materials of those coatings are initially selected to accomplish this function. To this end, both the insulation coating 14 and the semiconductive coating 16 are formed from materials which melt and expose the low voltage conductors 12 during the soldering operation. In addition, the thicknesses of the coatings 14 and 16 are limited to further facilitate their melting during a soldering operation consistent with the function of the semiconductive coatings 16 for forming a ground shield for each of the conductors 12.

Preferably, the insulation coatings 14 are formed with an overall thickness within the approximate range of 0.5 mils to 5 mils. In order to insure that the insulation and shield will melt during the soldering operation, the materials of which they are comprised should, of course, have melting temperatures equal to or lower than the soldering temperature. For example, the insulation coating 14 may be formed from a polyurethane material or a polyurethane with a relatively thin nylon overcoat. Other examples of materials for the insulation coating 14 include polyesters, photopolymers, polypropylene as well as other similar thermoplastic and dielectric materials. Further, such melting temperatures should not be lower than the ambient temperature expected in the region where the cable is employed. As a general rule, the melting temperature of the insulation and shielding should be at least about 105° C.

Because the invention relates to ultra-miniature cables which are typically connected using soft soldering techniques, and because very high temperatures may damage the cable, the melting temperatures of the insulation and shield materials should be relatively low as compared with many materials conventionally employed for such purposes. Since the highest melting temperatures for conventional soft solders are in the area of about 250° C., the insulation and shield materials utilized in the ultra-miniature cables of the present invention should preferably have melting temperatures below this general level.

When a plurality of stranded conductors 12 are employed within the cable as illustrated in FIG. 1, each of the low voltage conductors 12 is formed from one of the conductive materials listed above and is within the approximate size range of 52 to 32 AWG. Each of the conductors 12 is preferably 40 AWG copper stranding to form a 32 AWG composite conductor (7 × 40) for the cable.

The size of the conductors 12 and the thicknesses of the various coatings including the insulation coating 14 and the semiconductive coating 16 are selected to maintain an overall diameter for the cable 10 of approximately 0.015 to 0.025 inches (or 0.0375 to 0.0625 centimeters).

The semiconductive coating 16 is selected to have a thickness within the approximate range of 1 to 10 mils. It is again noted that the function of the semiconductive coating 16 is to provide a ground shield for the cable. Accordingly, it is not essential that the semiconductive coating 16 be electrically continuous as was described above for the insulation coatings 14.

The coating 16 may also be formed for example from conductive PVC (polyvinyl chloride) or polyethylene for example. Normally, such conductive polymers are prepared by loading the resin with carbon or other conductive particles to provide an appropriate degree of electrical conductivity.

The thickness of the insulation coating 14 serves not only to maintain the overall minimum diameter for the cable 10 but also to permit the semiconductive coating 16 to more readily accomplish its function of dissipating any external signals from around the low voltage conductors 12.

Figure 1A:
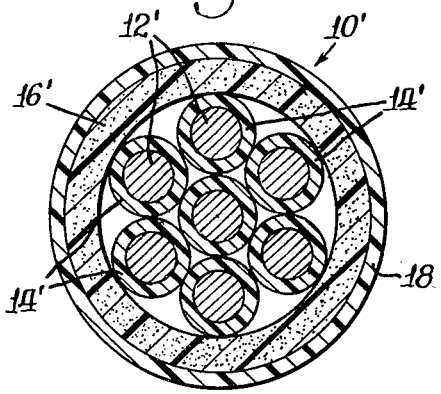
FIG. 1A is a sectioned view of a cable similar to that of FIG. 1 while also including an external insulation coating.

The embodiment of FIG. 1A is generally similar to that of FIG. 1. Accordingly, components of the FIG. 1A which corresponds to components of the FIG. 1 embodiment are indicated by similar primed numerals. It may thus be seen that the cable 10' of FIG. 1A also includes seven similar low voltage conductors 12' which have individual insulation coatings 14'. The combination of insulation coated conductors 12' is surrounded by a semiconductive coating 16'. The conductors 12', the insulation coatings 14' and the semiconductive coating 16' are each similar to the components 12, 14 and 16 described above in connection with FIG. 1.

In addition, the cable 10' of FIG. 1A includes an external insulation coating 18 which may optionally be used to provide electrical protection for the semiconductive coating 16'. The external insulation coating 18 is preferably of the same composition as the insulation coating 14 or 14' to permit it to be similarly removed or melted during soldering of the cable 10'. In addition, the thickness of the coating 18 is also maintained at a minimum within the approximate range of 0.5 to 5 mils for example.

Figure 2:
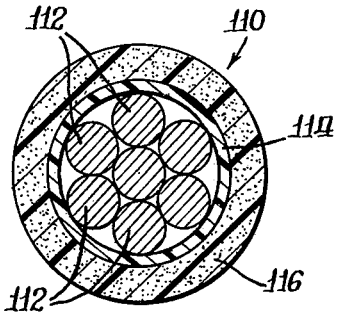
FIG. 2 is a sectioned view of a shielded ultra-miniature cable including a plurality of stranded conductors having a common insulation coating.

Referring now to FIG. 2, yet another shielded ultra-miniature cable is illustrated at 110 and includes various components which also conform closely with those described above for FIG. 1. Accordingly, the last two digits of the numerical labels for components in FIG. 2 correspond with the numerical labels in FIG. 1 for similar components. For example, the cable 110 of FIG. 2 also includes a plurality of seven stranded low voltage conductors 112.

The cable 110 differs from the cable 10 of FIG. 1 primarily in that the internal insulation coatings for the cables 112 are provided as a single layer 114 which surrounds the seven stranded conductors 112. The conductive coating 114 is similarly surrounded by a semiconductive coating 116. Here again, the material and thicknesses for the conductors 112, the insulation coatings 114 and the semiconductive coating 116 are substantially similar to those described above for the components 12, 14 and 16 of FIG. 1.

Figure 2A:
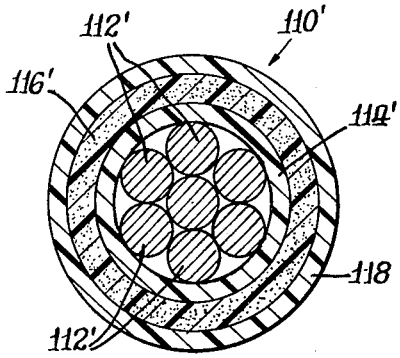
FIG. 2A is a sectioned view of a cable similar to that of FIG. 2 while also including an external insulation coating.

The embodiment of FIG. 2A is generally similar to that of FIG. 2 and includes corresponding components which are referenced by similar primed numerals. Accordingly, the cable 110' of FIG. 2A includes a similar plurality of low voltage conductors 112 surrounded by an insulation coating 114 and a semiconductive coating 116. The semiconductive coating 116 is in turn surrounded by an external insulation coating 118 which is substantially similar to the external insulation coating 18 of FIG. 1A.

Figure 3:
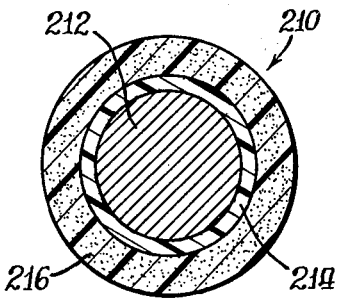
FIG. 3 is a sectioned view of yet another embodiment of a shielded ultra-miniature cable according to the present invention while including a single low voltage conductor.

In FIG. 3, yet another shielded ultra-miniature cable 210 is illustrated which is also constructed in accordance with the present invention. The cable 210 of FIG. 3 varies from the embodiments of FIGS. 1–2A primarily in that a single low voltage conductor 212 is employed. Accordingly, the diameter of the single conductor 212 may be proportionately larger than the stranded composite conductors 12 or 112 of FIGS. 1 and 2 respectively. Otherwise, the single conductor 212 is surrounded by an internal insulation coating 214 which corresponds to the insulation coating 114 of FIG. 2. The insulated conductor 122 is in turn surrounded by a semiconductive coating 216 which otherwise conforms with the semiconductive coatings 16 and 116 of FIGS. 1 and 2 respectively.

Figure 3A:
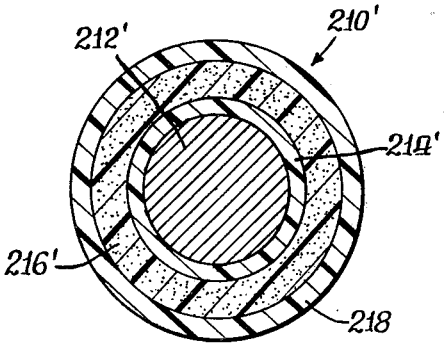
FIG. 3A is a sectioned view of a cable similar to that of FIG. 3 while also including an external insulation coating.

Referring now to FIG. 3A, a shielded ultra-miniature cable is indicated at 210' which conforms closely with the cable 210 of FIG. 3 similar components in the embodiment of FIG. 3A being indicated by similar primed numerals. Accordingly, the cable 210' of FIG. 3A includes a single low voltage conductor 212' surrounded by an insulation coating 214' and a semiconductive coating 216'. The semiconductive coating 216' is in turn surrounded by an external insulation coating 218 which conforms with the external insulation coatings 18 and 118 of FIGS. 1A and 2A respectively.

As was indicated above, any of the cables 10, 10', 110, 110', 210 or 210' may preferably be employed as a low voltage connection which is maintained substantially free from external signals. To employ any of the cables in such an application, it is additionally contemplated that the low voltage conductors of any of the cables may be electrically connected by a simple soldering operation without the need to first remove any of the insulation or semiconductive coatings. As indicated above, this is accomplished by selecting the material and thickness for the various coatings so that they will melt during the soldering operation and expose the low voltage conductors employed for the various cables.

Thus, the present invention also contemplates a method of forming an electrical connection with a shielded ultra-miniature cable wherein the cable is first formed in accordance with the preceding descriptions for any of the cables 10, 10', 110, 110', 210 or 210'. Thereafter, a conventional soldering operation is performed to electrically connect one end or portion of any one of the cables with another component such as a probe for an electrostatic voltmeter (not otherwise shown). During the soldering operation, the internal insulation coating, the semiconductive coating and any external insulation coating employed on the cable are melted by the heat of the soldering operation to expose the low voltage conductor and permit formation of an effective electrical solder connection. This method of operation may, of course, be employed with any of the embodiments of FIGS. 1–3A to form such a solder connection.

Various modifications and variations will obviously be possible within the scope of the present invention for any of the embodiments of FIGS. 1–3A. Accordingly, the scope of the present invention is defined only by the following appended claims.

What is claimed is:

1. A shielded ultra-miniature low voltage cable comprising at least one low voltage conductor, an internal insulation coating surrounding said conductor and a semiconductive coating surrounding and providing a ground shield for said insulation coated conductor, the materials of the insulation and semiconductive coatings being thermoplastic and having melting temperatures equal to or less than that of a predetermined soldering temperature in order to permit soldering of said shielded cable without requiring prior removal of said semiconductive and insulation coatings, the cable having a maximum outside diameter in the range of approximately 0.025 inches.

2. The ultra-miniature cable of claim 1 wherein the melting temperatures of the materials of the insulation and semiconductive coatings are each at least about 105° C. and less than about 250° C.

3. The ultra-miniature cable of claim 1 further comprising an outer insulation coating surrounding said semiconductive coating, said outer insulation coating also being formed from thermoplastic material having a melting temperature equal to or less than that of said predetermined soldering temperature.

4. The ultra-miniature cable of claim 1 wherein said internal insulation coating has a thickness in the approximate range of 0.5 to 2.5 mils and said semiconductive coating has a thickness in the approximate range of 1 to 10 mils.

5. The ultra-miniature cable of claim 1 further comprising a plurality of stranded low voltage conductors surrounded in common by said internal insulation coating.

6. The ultra-miniature cable of claim 1 further comprising a plurality of stranded low voltage conductors, each of said low voltage conductors being separately surrounded by said insulation coating.

7. The ultra-miniature cable of claim 1 wherein said insulation coating is selected from a class of materials consisting of polyurethane, polyurethane with a thin nylon overcoating, polyester, photopolymer and polypropylene.

8. The ultra-miniature cable of claim 1 wherein said semiconductive coating is selected from a class of materials consisting of conductive polyvinyl chloride, conductive polyethylene and conductive polymers.

9. A shielded, ultra-miniature low voltage cable for low voltage level instrumentation comprising at least one low voltage conductor, an insulation coating surrounding said conductor, said insulation coating being formed from a thermoplastic material and having a thickness in the approximate range of 0.5 to 2.5 mils, and a semiconductive coating surrounding and providing a ground shield for said insulation coated conductor, said semiconductive coating being formed from a thermoplastic material having a thickness in the approximate range of 1 to 10 mils whereby the thickness and material of said insulation and semiconductive coatings permit solder connection of said conductor without prior removal of said insulation and said semiconductive coatings while maintaining ultra-miniature size of said cable, said semiconductive coating serving to prevent spurious noise pickup or voltage imposition on said low voltage conductor, the cable having a maximum outside diameter in the range of approximately 0.025 inches.

10. The ultra-miniature cable of claim 9 further comprising an outer insulation coating surrounding said semiconductive coating, said outer insulation coating also being formed from thermoplastic material of such type and thickness as to permit solder connection of said conductor without prior removal thereof.

11. The ultra-miniature cable of claim 9 further comprising a plurality of stranded low voltage conductors surrounded in common by said internal insulation coating.

12. The ultra-miniature cable of claim 9 further comprising a plurality of stranded low voltage conductors, each of said low voltage conductors being separately surrounded by said insulation coating.

13. The ultra-miniature cable of claim 9 wherein said insulation coating is selected from a class of material consisting of polyurethane, polyurethane with a thin nylon overcoating, polyester, photopolymer and polypropylene, and said semiconductive coating is selected from a class of materials consisting of conductive polyvinyl chloride, conductive polyethylene and conductive polymers.

* * * * *

UNITED STATES PATENT AND TRADEMARK OFFICE

CERTIFICATE OF CORRECTION

PATENT NO. : 4,143,238

DATED : March 6, 1979

INVENTOR(S) : Ramesh D. Sheth

It is certified that error appears in the above-identified patent and that said Letters Patent are hereby corrected as shown below:

In the References Cited, on the last line of the first column, the Berends Patent is incorrectly dated 12/1969, it should read -- 3/1971 --.

In column 5, line 18, "conductor 122" should be -- conductor 212 --.

Signed and Sealed this

*Fourth* Day of *September 1979*

[SEAL]

*Attest:*

*Attesting Officer*

LUTRELLE F. PARKER

*Acting Commissioner of Patents and Trademarks*